US006156716A

United States Patent [19]

Ahmed

[11] Patent Number: 6,156,716

[45] Date of Patent: Dec. 5, 2000

[54] HEAVY DUTY DEGREASER CLEANING COMPOSITIONS AND METHODS OF USING THE SAME

[75] Inventor: Fahim U. Ahmed, Greensboro, N.C.

[73] Assignee: Kay Chemical Incorporated, Greensboro, N.C.

[21] Appl. No.: 09/306,755

[22] Filed: May 7, 1999

[51] Int. Cl.[7] ..... C11D 1/72; C11D 3/10; C11D 7/06

[52] U.S. Cl. ..... 510/272; 510/197; 510/235; 510/254; 510/421; 510/434; 510/435; 510/499; 510/509

[58] Field of Search ..... 510/185, 197, 510/245, 235, 254, 272, 421, 434, 435, 499, 509

[56] References Cited

U.S. PATENT DOCUMENTS 5,534,198 7/1996 Masters et al. ..... 510/182
5,629,278 5/1997 Baeck et al. ..... 510/236

*Primary Examiner*—Gregory R. Delcotto
*Attorney, Agent, or Firm*—Finnegan, Henderson, Farabow, Garrett & Dunner, L.L.P.

[57] ABSTRACT

Applicant discloses heavy duty degreaser cleaning compositions having reduced alkalinity and reduced corrosion properties for removing grease and/or oil from surfaces, and that contain:

(a) about 1 to about 40 wt % of a builder having the following structure or a salt thereof:

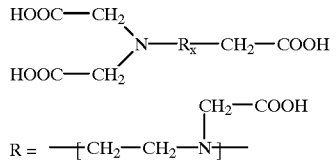

*x* is 0~5, and preferably 1~3.

(b) about 1 to about 40 wt % of an alkaline metal carbonate;

(c) about 0 to about 20 wt % of a surfactant;

(d) 0 to about 20 wt % of a hydrotropic solvent;

(e) 0 to about 10 wt % of a source of alkalinity; and (f) balance water.

2 Claims, No Drawings

HEAVY DUTY DEGREASER CLEANING COMPOSITIONS AND METHODS OF USING THE SAME

FIELD OF INVENTION

The present invention relates to heavy duty degreaser cleaning compositions and methods for using them. More particularly, the invention relates to cleaning compositions useful for removing automotive oils and exhausts and industrial lubricants from surfaces and cooking oils or shortening and buildups thereof from deep-fat-fryers or other cooking equipment.

BACKGROUND OF INVENTION

The advent of industrialization has also brought a need to address unwanted ecological and aesthetic effects in the environment. Internal combustion engines such as gasoline engines or diesel engines leave noticeable deposits in confined areas such as drive-throughs, garages and the like, which require cleaning. These power plants and others, such as electric motors, steam turbines, gas turbines and the like, as well as motor driven equipment such as air-conditioners, home appliances, and hydraulic equipment require lubricating oils, but have a tendency to leak lubricants into the area where they are employed, and require clean up of the residues. Typically these unwanted products build up in areas such as garages, factories, boating ramps, warehouses, drive-through areas of retail establishments and the like.

The deposit of cooking oils or shortenings as buildups or residues, e.g., polymerized or carbonized products, occurs in cooking equipment such as for example, deep-fat fryers, cooking oil or shortening filters, fryer baskets, skillets, pots, kettles, stove ventilation hoods, exhaust stacks, and associated equipment such as air filters, tubing for electrical conduits or other tubing, glass or plastic lighting-shields and the like whether in quick service/fast food restaurants or otherwise. Users of these processes and materials also require removal of these deposits for safety, ecological, sanitary and aesthetic reasons.

Additionally, there are many related industrial, institutional, and home needs for general degreasing/spot cleaning, of doors, windows, counter-tops, kitchen, eating and serving tables and areas and the like.

Even with available cleaners, it is difficult to remove these stubborn, tenacious oily soils, and few if any can perform all or multiple degreasing and/or cleaning functions as noted above.

For example, deep-fat fryer deposits generally comprise polymerized and carbonized soils of fats and oils, typically removed with hazardous, highly alkaline, caustic soda or silicate based corrosive cleaners, as used in fryer boil-out or other cleaning techniques. This poses and causes hazards due to spills on clothes and body tissue such as skin, eyes and the like. Therefore, present applications call for a milder non-corrosive degreaser for fryer boil-out for these reasons, but also highly alkaline and corrosive products damage and corrode equipment. Industry also does not desire to use a highly alkaline and corrosive product for cleaning motor oil/lubricant and exhaust deposits in places such as drive-throughs for safety reasons.

Also, in most instances the cleaning materials will emulsify the soil such as grease, oil and the like which will eventually wash out to a sewer-drain and for this reason the industry requires a biodegradable and environmentally friendly degreaser to cause little or minimal environmental impact.

The incorporation of phosphates into detergents provides more effective rinsing of the cleaner from the treated surface. They also sequester metal ions, act as buffers and synergists for the surfactants. However, phosphates in cleaning water effluents will drain into waterways and promote algae and other plant growth, which over time will eutrophy water bodies and waterways. Past attempts to control phosphate effluents have reduced their concentration to fairly low limits. However, meeting these constraints by lowering phosphate concentrations has met with some difficulty in that low phosphate cleaners do not perform effectively in meeting their designed objectives.

The wide variety of available phosphate-free detergent and degreaser compositions do not give entirely satisfactory results for clean up of lubricants such as motor oil, cooking oils or fats or their polymerized or carbonized by-products that collect on cooking utensils, and cooking equipment such as frying vessels. A heavy duty degreaser for cleaning both lubricants as well as fats and oils employed in cooking applications and their polymerized and/or carbonized by-products would provide an important benefit and would answer routine needs in the industry.

Thus, known detergent formulations are either too weak or ineffective for use in heavy duty cleaning operations, or too strongly alkaline, or corrosive which limit their use because of safety problems they pose to operators and materials they come in contact with. On the other hand, those suitable for use in both applications most often contain harsh, petroleum or solvent bases or toxic components, do not biodegrade and usually are environmentally unfriendly or otherwise unsuitable for large scale industrial and institutional use.

In summary, the use of automotive and other industrial lubricants as well as cooking oils, or shortenings worldwide has brought about a need to develop compositions capable of effectively cleaning these materials in various environments, ranging from automobile garages and industrial manufacturing sites to fast-food restaurants. The ideal composition would effectively clean lubricants and cooking oils or shortenings or polymerized and carbonized residues thereof from any natural or manmade surface.

RELATED ART

MacNamara et al. U.S. Pat. No. 4,093,566 discloses a silicate based cleaning composition intended for cleaning metallic ammunition components. This composition consisted of 50 percent sodium metasilicate, with either 40 percent sodium carbonate and 10 percent ethylenediaminetetraaceticacid or 20 percent sodium carbonate and 30 percent sodium hydroxide. These highly alkaline compositions necessarily pose an increased risk to users of the composition and the environment. Although useful as a spray cleaner for removing oils and greases, it does not effectively clean tenacious polymerized/carbonized soil from cooking utensils such as deep-fat fryers, even though it is highly alkaline and corrosive.

Adone, U.S. Pat. No. 4,772,415 discloses a heavy duty degreaser composition for cleaning containers, engines, pipes and processing equipment used in the marine and refining industries. This degreaser composition contains 7–12 percent of a mixture of $C_9$ to $C_{11}$ primary alcohol ethoxylates, 2–5 percent of alkali metal silicate, 0.5 to 2 percent of a liquid alkaline metal hydroxide solution, 1.54 percent isopropanol, and 0.2–1 percent of a tetraalkaline metal salt of ethylenediaminetetraaceticacid tetrahydrate. As with the MacNamara et al. composition, the Adone material is also highly alkaline and corrosive but neither teaches nor suggests that the composition is effective in cleaning more tenacious oily soils such as baked-on, fried-on fats/oils on cooking utensils and the like.

Leiter et al., U.S. Pat. No. 4,844,744 discloses a phosphate-free single phase degreasing composition for cleaning aluminum surfaces. These compositions contain alkali metal and/or ammonium carbonates, alkali metal and/or ammonium hydrogen carbonates, complexing agents other than acrylic polymers, one or more anionic or nonionic surfactants, and other optional ingredients typically used for degreasing compositions.

While the Leiter et al. compositions provide adequate buffering action and protection of the aluminum surface, it is ineffective to remove polymerized and carbonized soils from cooking and/or frying utensils.

PURPOSE OF THE INVENTION

The invention has as a purpose providing a cleaning composition to effectively clean lubricants and cooking oils, or shortenings, or residues thereof from any natural or manmade surface.

The invention also has as a purpose, providing a cleaning composition for removing automotive and other industrial lubricants from surfaces such as concrete, asphalt or other road surfaces, manufacturing equipment, or transportation equipment.

Another purpose of the invention comprises providing a cleaning composition for removing cooking oils or shortenings, or buildups, or residues comprising polymerized or carbonized products thereof, from the surface of cooking equipment including deep-fat-fryers, fryer baskets, cooking oil or shortening filters, skillets, pots, kettles, stove ventilation hoods and associated equipment, such as air filters, tubing for electrical conduits, other tubing, glass or plastic lighting-shields and the like.

The invention also has a purpose, to provide such a cleaning composition, but with a reduced level of alkalinity.

The invention also has another purpose to provide such a cleaning composition which poses a low risk to operators in contact with the composition.

The invention also has as an additional purpose, to provide nontoxic and noncorrosive aqueous compositions that do not have organic solvents.

The invention also has a purpose providing of such a cleaning composition with poses a low risk to the environment.

A purpose of the invention also comprises providing a single composition that will effectively act to clean lubricants or cooking oils or shortenings, or their residues form any natural or manmade surface.

A further purpose of the invention comprises a method of cleaning any surface contaminated with a lubricant or shortening or cooking oil, or their residues with a cleaning composition that has the foregoing properties.

SUMMARY OF THE INVENTION

To achieve these and other purposes, and in accordance with the purpose of the invention, as embodied and broadly described herein, one aspect of the invention comprises:

A heavy duty degreaser cleaning composition comprising:

(a) about 1 to about 40 wt % of a builder comprising a tertiary amine carboxylic acid, such as those having the following structure, or a salt thereof:

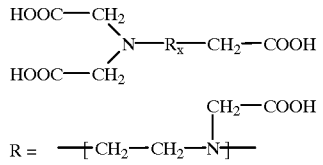

(b) about 1 to about 40 wt % of an alkaline carbonate;

(c) about 0 to about 20 wt % of a surfactant;

(d) 0 to about 20 wt % of a hydrotropic solvent;

(e) 0 to about 10 wt % of a source of alkalinity; and (f) balance water.;

In a preferred embodiment, the builder comprises EDTA or salts thereof, the alkaline carbonate comprises potassium carbonate; the composition contains only one surfactant, especially a nonionic surfactant such as a linear primary alcohol ethoxylate; the hydrotropic solvent comprises sodium xylene sulfonate; and the source of alkalinity comprises an alkali metal hydroxide.

DETAILED DESCRIPTION OF THE INVENTION

Conventionally, compositions formulated to remove automotive or other industrial lubricants from surfaces, or cooking oil and shortening, or buildups or residues thereof from cooking equipment, either contained phosphates and/or increased levels of alkaline compounds such as alkaline hydroxides or silicates. Aside from posing a hazard to operators using the composition as well as the environment, these compositions can cause corrosion of the soiled surface. Also, using silicates in cleaning compositions has a disadvantage in that its use results in the buildup of silicates on the surface, especially quarry tiles, leaving a white stain or coating, generally removed by treatment with hydrofluoric acid.

Accordingly, the invention, provides a cleaning composition without phosphates or silicates, and designed to effectively clean lubricants and cooking oils or shortenings or residues thereof from any natural or manmade surface.

The invention also provides a cleaning composition effective in lubricant and motor oil and cleanup applications include cleaning lubricants such as motor oil from various surfaces such as for example concrete, asphalt or other road surfaces, garages, manufacturing equipment, or transportation vehicles.

In another embodiment, the invention also provides a composition effective in removing cooking oils, shortenings, or buildups or residues thereof, e.g., polymerized or carbonized products thereof, from cooking equipment, such as for example, deep-fat-fryers, cooking oil or shortening filters, fryer baskets, skillets, pots, kettles, stove ventilation hoods, exhaust stacks and associated equipment, such as air filters, tubing for electrical conduits or other tubing, glass or plastic lighting-shields and the like.

In another embodiment, the invention provides a composition effective in both respects, i.e., a single composition for cleaning both lubricants and cooking oils, shortenings, or buildups or residues thereof from surfaces.

The invention also provides a composition that carries a low risk to those using it as well as presenting minimal risk to the environment, while maintaining a high degree of efficacy.

The degreaser cleaning composition contains (a) about 1 to about 40 wt % of a builder, and especially from about 1 to about 30 wt % of a builder comprising tertiary amine carboxylic acid or salt thereof, especially one having the following structure:

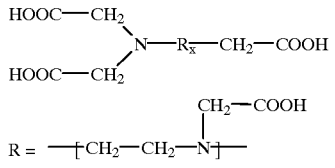

$x$ is 0~5, and preferably 1~3.

and (b) about 1 to about 40 wt % of an alkaline carbonate.

In a further embodiment the degreaser composition includes (c) about 0 to about 20 wt % of a surfactant;

(d) 0 to about 20 wt % of a hydrotropic solvent;

(e) 0 to about 10 wt % of a source of alkaline material; and (f) balance water.

The preferred builder [component (a)] comprises a relatively weak builder such as ethylenediaminetetraaceticacid (EDTA) and salts thereof, although equivalent compounds such as N-hydroxyethylenediaminetriacetic acid (HEDTA), diethylenetriaminepentaaceticacid (DTPA) or nitrilotriacetic acid (NTA) and salts of all of the foregoing also function as substitutes, either in whole or in part for EDTA. NTA, by itself, however, does not comprise a preferred builder. The salts comprise those based on the Group IA metals (i.e., Li, Na, K, and the like) or Group IIA alkaline earth metal carbonates (i.e., Mg, Ca, and the like), ammonia, amines or hydroxylamines (as those terms are subsequently defined herein). The preferred salts comprise the alkali metal salts, especially the sodium and potassium salts. The foregoing builder [component (a)] also comprises any mixture of these builders, and/or their salts, such as, the two, three or four component mixtures.

A preferred alkaline carbonate [component (b)], also a relatively weak builder, comprises potassium carbonate although other alkali metal carbonates find use in the invention as substitutes in whole or in part for potassium carbonate and include the carbonates of the other Group IA metals (as defined herein) or Group IIA alkaline earth metals (as defined herein), or ammonium carbonate, or carbonates of amines or hydroxylamines (as those terms are subsequently defined herein). The term "carbonate" as used herein, also includes bicarbonates of any of the foregoing carbonates. The preferred salts comprise the alkali metal salts, especially the potassium and sodium salts. The foregoing builder [component (b)] also comprises mixtures of these salts, especially the two, three or four component mixtures. Other non-phosphate builders include sodium or potassium salts of citric acid, aspartic acid, zeolites, polyacrylates and polyacrylate-methacrylate copolymers and the like.

Degreaser compositions having a combination of the two relatively weak builders, [components (a) and (b)] such as tetra sodium EDTA and/or its equivalents and potassium carbonate and/or its equivalents, unexpectedly provided effective cleaning power to clean the stubborn and very tenacious stains or coatings of automotive or other lubricants, cooking oils or shortenings and buildups, or residues thereof form surfaces, such as those described herein.

Because of this unexpected cleaning power, provided by the (a) and (b) components alone, the compositions described herein can contain a reduced number of components, making the compositions relatively simple. Reducing the number of components in the cleaning compositions, while maintaining effective cleaning power, carries the advantage of reducing risk to those using the composition as well as reducing risk to the environment, and reducing the cost of the compositions.

The foregoing advantages allow formulation of the cleaning compositions preferably to contain only a single surfactant, although the compositions of the invention may contain additional surfactant such as two, three or four surfactants. The preferred surfactant for this purpose comprises a nonionic linear primary alcohol ethoxylate such as NEODOLO® 1-5 (56% EO, HLB 11.2, cloud point 64° F.) sold by Shell Chemical Company. This surfactant comprises a 5-mole ethoxylate of an 11-carbon atom primarily alcohol. The addition of NEODOL® 1-5 to the composition of (a) and (b) components unexpectedly delivered the basis oil removal performance. Although the preferred cleaning composition contains NEODOL® 1-5, the composition can also employ other surfactants in place of NEODOL® 1-5 or combinations thereof, especially the two, three or four component combinations.

These other surfactants include nonionic, amphoteric, anionic, or cationic surfactants all well known in the art and described in Kirk Othmer, Encyclopedia of Chemical Technology 3rd Edition, Vol.22, pp.332–432 and Holtzman, et al. U.S. Pat. No. 4,715,894, both incorporated herein by reference.

Examples of other nonionic surfactants include NEODOL® 91-2.5 (42% EO, HLB 8.5, cloud point 35.8° F.) and NEODOL® 91-8 (70% EO, HLB 13.9, cloud point 176° F.) also sold by Shell Chemical Company based on a mixture of primary alcohols having from about 9 to about 11 carbon atoms and 2.5 moles of ethoxylate and 8 moles of ethoxylate respectively. Other surfactants suitable in this regard comprise SURFONIC® L 12-6 (62% EO, HLB 12.4, cloud point 48° C.) sold by Huntsman Chemical Company, which comprises a 6-mole ethoxylate of a primary alcohol having from about 10 to about 12 carbon atoms. Additional suitable surfactants comprise POLYTERGENT® ULTRA A, sold by Olin, which comprises an ethoxylated alcohol and other proprietary materials and ACINTOL® FA-1 ACID, sold by Humko and comprises tall oil fatty acids, mainly oleic acid. Amphoteric surfactants useful in the cleaning composition include compounds such as MIRANOL® FBS, sold by Rhodia which comprises an imidazoline based amphoteric, sodium cocoamphopropionate (39%).

The degreaser cleaning compositions preferably contain only a single nonionic linear primary alcohol ethoxylate.

These nonionic water-soluble and water-dispersible surfactants broadly comprise polyoxyalkylene glycol ethers based on alkylene oxides having from 2 to about 4 carbon atoms. These, and the other surfactants described herein have a molecular weight ranging from about 200 to about 600 especially from about 220 to about 550 preferably from about 230 to about 500. The surfactants of the invention also have an HLB of from about 3 to 20 especially from about 4 to 18 and preferably from about 5 to about 15 and a cloud point of from about 100 to 180° F. especially from about 12° to 150° F. and preferably from about 13° to about 130° F.

More specifically, the polyoxyalkylene glycol ether nonionic water-soluble polymers comprise polyoxyethylene glycol ether all-block, block-heteric, heteric-block or heteric-heteric block copolymers where the alkylene units have from 2 to about 4 carbon atoms, i.e., those alkylene units based on alkylene oxides having from 2 to about 4 carbon atoms. The surfactants contain hydrophobic and hydrophilic blocks where each block is especially based on oxy-ethylene groups or oxypropylene groups or mixtures of these groups.

The most common method of obtaining these materials comprises reacting an alkylene oxide such as ethylene oxide with a material that contains at least one reactive hydrogen. Alternative routes include the reaction of the active hydrogen material with a preformed polyglycol or the use of ethylene chlorohydrin instead of an alkylene oxide.

The reacting active hydrogen material must contain at least one active hydrogen, preferably alcohols, and optionally acids, amides, mercaptans, alkyl phenols and the like. Primary amines can be used as well.

Especially preferred materials are those obtained by block polymerization techniques. By the careful control of monomer feed and reaction conditions, a series of compounds, e.g., surfactants, can be prepared in which such characteristics as the hydrophile-lipophile balance (HLB), wetting and foaming power can be closely and reproducibly controlled. The chemical nature of the initial component employed in the formation of the initial polymer block generally determines the classification of the materials. The initial component does not have to be hydrophobic. In the case of surfactants, hydrophobicity will be derived from one of the two polymer blocks. Typical starting materials or initial components include monohydric alcohols such as methanol, ethanol, propanol, butanol and the like and preferably primary alcohols. Dihydric materials such as glycol, glycerol, higher polyols, ethylene diamine and the like comprise alternate starting materials.

The various classes of materials, suitable for practice of this aspect of the present invention that are surfactants, have been described by Schmolka in "Non-Ionic Surfactants," Surfactant Science Series Vol. 2, Schick, M. J., Ed. Marcel Dekker, Inc., New York, 1967, Chapter 10 which is incorporated herein by reference.

The first and simplest copolymer is that in which each block is homogeneous which is to say a single alkylene oxide is used in the monomer feed during each step in the preparation. These materials are referred to as all-block copolymers. The next classes are termed block-heteric and heteric-block, in which one portion of the molecule is composed of a single alkylene oxide while the other is a mixture of two or more such materials, one of which may be the same as that of the homogeneous block portion of the molecule. In the preparation of such materials, the hetero portion of the molecule will be totally random. The properties of these copolymers will be entirely distinct from those of the pure block copolymers. The other class is that in which both steps in the preparation of the different repeating units involve the addition of mixtures of alkylene oxides and is defined as a heteric-heteric block copolymer.

The block copolymer is typified by a monofunctional starting material such as a monohydric alcohol, acid, mercaptan, secondary amine or N-substituted amides. These materials can generally be illustrated by the following formula:

$$I—[A_m—B_n]_x \quad (1)$$

where I is the starting material molecule as described before. The A portion is a repeating unit comprising an alkylene oxide unit in which at least one hydrogen can be replaced by an alkyl group or an aryl group, and m is the degree of polymerization which is usually greater than about 6. The B moiety is the other repeating unit such as oxyethylene with n again being the degree of polymerization. The value of x is the functionality of 1. Thus, where I is a monofunctional alcohol or amine, x is 1; where I is a polyfunctional starting material such as a diol (e.g., propylene glycol), x is 2 as is the case with the Pluronic® surfactants. Where I is a tetrafunctional starting material such as ethylenediamine, x will be 4 as is the case with Tetronic® surfactants. Preferred copolymers of this type are the polyoxypropylene-polyoxyethylene block copolymers.

Multifunctional starting materials may also be employed to prepare the homogeneous block copolymers.

In the block-heteric and heteric-block materials either A or B will be a mixture of oxides with the remaining block being a homogeneous block. Where the copolymer is a surfactant, one block will be the hydrophobe and the other the hydrophile and either of the two polymeric units will serve as the water solubilizing unit, and the other as the organophile, but the characteristics will differ depending on which is employed. Multifunctional starting materials can also be employed in materials of this type.

The heteric-heteric block copolymers are prepared essentially the same way as discussed previously with the major difference being that the monomer feed for the alkylene oxide in each step is composed of a mixture of two or more materials. The blocks will therefore be random copolymers of the monomer feed. In the case of surfactants, the solubility characteristics will be determined by the relative ratios of potentially water soluble and water insoluble materials.

These copolymers, as represented by formula (I), are prepared so that the weight ratio of A to B repeating units will also vary from about 0.4:1 to about 2.5:1, especially from about 0.6:1 to about 1.8:1 and preferably from about 0.8:1 to about 1.2:1.

In one embodiment, these copolymers have the general formula:

$$RX(CH_2CH_2[CH_2]O)_nH \quad (2)$$

where R has an average molecular weight of from about 120 to about 250, especially from about 130 to about 240 and preferably from about 135 to about 235, and where R is usually a typical surfactant hydrophobic group but may also be a polyether such as a polyoxyethylene group, a polyoxypropylene group, or a polyoxybutylene group, or a mixture of these groups. In the above formula X is either oxygen or nitrogen or another functionality capable of linking the polyoxyalkylene chain to R, and y has a value of 0,1, or 2. In most cases, n, the average number of alkylene oxide units must be greater than about 5 or about 6. This is especially the case where it is desired to impart sufficient water solubility to make the materials useful.

In one embodiment, these copolymers have the general formula:

$$RX(CH_2CH_2O)_nH \quad (3)$$

where R has an average molecular weight of from about 120 to about 250, especially from about 130 to about 240 and preferably from about 135 to about 235. The average molecular weight for R of the low molecular weight polyoxyalkylene glycols is from about 120 to about 250, and especially from about 130 to about 235. R is usually a typical surfactant hydrophobic group but may also be a polyether such as a polyoxyethylene group, a polyoxypropylene group, or a polyoxybutylene group, or a mixture these groups. In the above formula X is either oxygen or nitrogen or another functionality capable of linking the polyoxyethylene chain to R. In most cases, n, the average number of oxyethylene units in the oxyethylene group, must be greater than about 5 or about 6. This is especially the case where it is desired to impart sufficient water solubility to make the materials useful.

As noted before, the preferred polyoxyalkylene glycol ethers are the non ionic polyether-polyol block-copolymers.

However, other nonionic block-copolymers useful in the invention can be modified block copolymers using the following as starting materials: (a) secondary or tertiary alcohols, (b) fatty acids, (c:) alkylphenol derivatives, (d) glycerol and its derivatives, (e) fatty amines, (f)-1,4-sorbitan derivatives, (g) castor oil and derivatives, and (h) glycol derivatives.

An example of such a surfactant comprises the NEODOL® type surfactants and SURFONIC® Type surfactants.

The surfactants present are preferably adducts of ethylene oxide and/or propylene oxide with fatty alcohols, $C_6$–$C_{22}$-alkylphenols, fatty amines, fatty-alkyl-derivatized ether amines, unsaturated, epoxidized and, optionally, ring-opened (with monohydric alcohols) and saturated fatty acids containing about 6 to about 22 carbon atoms in the linear or branched alkyl radicals.

Anionic surfactants include alkyl benzenesulfonic acids, alkane sulfonic acids, alkyl sulfates and alkyl ether sulfates and water-soluble salts thereof, preferably alkali metal and/or ammonium salt. They contain about 6 to about 22 carbon atoms in the alkyl radical. In adducts such as these, an average of about I to about 20 mol of the particular alkylene oxide is added on to about 1 mol of the particular fatty derivative, i.e., fatty alcohol, alkylphenol, fatty amine, ether amine or fatty acid or fatty acid derivatives.

More specific nonionic surfactants include adducts of ethylene oxide and/or propylene oxide with fatty alcohols from the group comprising octanol, nonanol, decanol, undecanol, dodecanol, tridecanol, tetradecanol, pentadecanol, hexadecanol, heptadecanol, octadecanol, nonadecanol, eicosanol, uneicosanol, or docosanol, preference normally being attributed to the linear fatty alcohols and also to mixtures of such alcohols which are inexpensively obtainable on an industrial scale from natural fats or oils and mixtures thereof. For example, adducts of ethylene oxide and/or propylene oxide with tallow fatty alcohols, coconut fatty alcohols and/or comparable fatty alcohol mixtures of native origin may be used with particular advantage.

Adducts of alkylphenols containing about 6 to about 22 carbon atoms in the alkyl radical may also be used as the surfactant component in accordance with the invention. Accordingly, ethylene oxide and/or propylene oxide may be added to the above-mentioned quantitative ratios onto alkylphenols containing the following groups as the alkyl chain: hexyl, heptyl, octyl, nonyl, decyl, undecyl, dodecyl, tridecyl, tetradecyl, pentadecyl, hexadecyl, heptadecyl, octdecyl, nonadecyl, eicosyl, uneicosyl or docosyl. Both the linear and the branched alkyl radicals are suitable, although the linear alkylphenols are particularly preferred for forming the adducts because they are more readily obtainable from natural fats and oils. Mixtures of such adducts of ethylene oxide and/or propylene oxide with alkylphenols may also be used as surfactants.

Adducts of ethylene oxide and/or propylene oxide with fatty amines from the group comprising octylamine, nonylamine, decylamine, undecylamine, dodecylamine, tridecylamine, tetradecylamine, pentadecylamine, hexadecylamine, heptadecylamine, octadecylamine, nonadecylamine, eicosylamine, uneicosylamine and docosylamine or even mixtures of such fatty amines may also be used in the singlephase degreasing compositions according to the invention. As with the fatty alcohols, the linear fatty amines from the group mentioned and mixtures of such fatty amines are particularly suitable for the formation of suitable adducts because they may be inexpensively obtained in large quantities from natural fats and oils.

Other more specific nonionic surfactants components suitable for use in accordance with the invention are adducts of ehtylene oxide and/or propylene oxide with fatty-alkyl-derived ether amines. These ether amines are tertiary amine's containing ether groups with at least one alkyl polyglycol ether group at the amino nitrogen atom. Suitable fatty alkyl radicals are the $C_6$–$C_{22}$ alkyl radicals which were mentioned above in connection with the alkyl-phenols. The number of ethylene oxide (E.O.) or propylene oxide (P.O.) groups are between about 2 and about 20. Corresponding compounds are described in German patent document No. 35 04 2442, incorporated herein by reference. In addition to individual compounds, mixtures of the adducts mentioned may also be used. Thus, both the length of the fatty alkyl groups and the number of recurring alkoxy units in the adduct formed may vary over a wide range.

The same applies to the adducts of ethylene oxide and/or propylene oxide with fatty acids which may also be used as surfactant component in accordance with the invention. Fatty acids such as these may be both unsaturated fatty acids containing about 8 to about 22 carbon atoms in the linear or branched alkyl radicals.

Accordingly, the surfactant component which may be used includes adducts of ethylene oxide and/or propylene oxide with caprylic acid, pelargonic acid, capric acid, undecanoic acid, lauric acid, tridecanoic acid, myristic acid, pentadecanoic acid, palmitic acid, margaric acid, stearic acid, nonadecanoic acid, arachic acid, uneicosanoic acid, behenic acid and the corresponding unsaturated carboxylic acids occurring in the starting products of native fats and oils normally used.

Similarly, it is possible to use adducts of ethylene oxide and/or propylene oxide with epoxidized unsaturated carboxylic acids and with epoxidized carboxylic acids ring-opened with monohydric alcohols after epoxidation as surfactant component.

One feature common to al the surfactants from the above-mentioned groups of adducts, which are suitable for use in the degreasing compositions according to the invention for aluminum surfaces, is than an average of about 1 to about 20 mol of the particular alkylene oxide is added onto 1 mol of the particular fatty derivative, i.e., fatty alcohol, fatty amine or the particular fatty acid. It is possible to use mixtures of ethylene oxide and propylene oxide for forming adducts such as these and thus to prepare adducts with the fatty derivatives mentioned which are both ethoxylated and propoxylated, the sequence of the ethoxy and propoxy groups being immaterial. A preferred number of such ethoxy and/or propoxy moieties is in the range from about 5 to about 15. In view of the more or less statistical ethoxylation or propoxylation reaction, mixtures of these adducts which contain a wide range of fatty derivatives alkoxylated to different extents are normally used as surfactant components.

In addition to the adducts mentioned above, more specific anionic surfactants comprise $C_6$–$C_{22}$ alkyl benzenesulfonic acids, $C_6$–$C_{22}$ alkane sulfonic acids, $C_6$–$C_{22}$ alkyl sulfates and $C_8$–$C_{22}$ alkyl ether sulfates and water soluble salts thereof, preferably alkali metal and/or ammonium salts and, more preferably, sodium and/or triethanolammonium salts, also may be used as surfactants in the inventive degreasing compositions. The alkyl radicals, which may be linear or branched, derive from the group mentioned above in connection with the alkylphenols. Once again individual compounds or mixtures may be used.

One or more surfactants having an HLB value in the range from about 3 to about 20 are preferably used as surfactants.

Within this range, and especially the narrower ranges as noted herein, the nonionic surfactants and, of these, the linear and/or branched fatty alcohol ethoxylates have proved to be particularly suitable because they ensure adequate solubility in water for a good cleaning effect by virtue of their balanced ratio of the hydrophilic to lipophilic part of the molecule. As already mentioned, both individual surfactants and also mixtures of different surfactants are used as essential surfactant components in the degreasing compositions according to the invention, providing they satisfy the requirements stated above.

In some instances, the composition may comprise two or more different surfactants.

While the first surfactant may comprise from about 0 to about 20.0 percent by weight of the cleaning composition, a preferred range comprises about 0.5 to about 15 percent by weight of the cleaning composition, a more preferred range comprises about 1 to about 12 percent by weight. When using other surfactants, in addition to the first surfactant, the additional surfactants may comprise from about 0.5 to about 15 percent by weight of the cleaning composition.

The cleaning composition may also include additional builders, well known in the art, such as sodium citrate, organic builders such as ACUSOL® 445N sold by Rohm & Haas and which comprises a polyacrylate with a molecular weight of 450. The additional builders, which do not include components (a), or component (b), e.g., potassium carbonate, comprise from about 0.1 percent by weight to about 15 percent by weight of the cleaning composition.

The cleaning composition may also include a hydrotropic solvent, ranging from 0 to about 20 percent by weight of the cleaning composition. Preferably, the hydrotropic solvent comprises from about 0.5 to about 15 percent by weight of the cleaning composition. The solvents include sodium xylene sulfonate, cumene sulfonate, sodium toluene sulfonate, water soluble propylene glycols and alcohol type materials generally containing from 1 to about 6 carbon atoms, especially alkyl alcohols, having from 1 to about 6 hydroxyl groups. Potassium and calcium salts can also be used. Examples of suitable materials comprise methanol, ethanol, propanol, butanol, glycerine, cetyl alcohol, hexanol, whether primary, secondary or tertiary alcohols and the various branched-chained isomers thereof.

Other hydrotropic solvents include materials such as polylxyalkylene glycols, whether copolymers or homopolymers, and preferably comprise water soluble polymers. Preferably, these copolymers and/or homopolymers are based on alkylene oxides having from 2 to about 6 and especially 2 to about 4 carbon atoms such as ethylene oxide, propylene oxide, butylene oxide and the like.

The hydrotropic solvent in the composition helps to provide a single phase liquid composition since some of the surfactants such as the NEODOL® surfactants are not readily soluble in water at room temperatures. Additionally, potassium carbonate in combination with EDTA and the tetrasodium salts thereof, also help to provide a single phase liquid composition, since potassium carbonate has a higher solubility in water than some of the other metal carbonates.

Importantly, the cleaning composition of the invention may also contain a material to impart alkalinity, preferably at relatively low levels to minimize danger to humans and the environment, minimize corrosiveness of the composition, and be safe to equipment. The material that provides alkalinity may comprise from 0 to about 10 percent by weight, preferably from about 0.25 to about 8 percent by weight of the composition and comprise potassium hydroxide or other metal hydroxides of Group IA alkali metals (as defined herein) hydroxides, hydroxides of Group IIA alkaline earth metals (also as defined herein), ammonium hydroxide or primary, secondary or tertiary amines, having up to about fifteen carbon atoms such as the aliphatic amines, alicyclic amines, cyclic or heterocyclic amines, as further described In Kirk-Othmer, (supra), Vols. 1 and 2, also incorporated herein by reference. These amines also include hydroxylamine and equivalent hydroxylamine compounds including beta-hydroxylamines such as alpha-methyl hydroxylamine, beta-methyl hydroxylamine, alpha-ethyl hydroxylamine and beta-ethyl hydroxylamine.

The free alkalinity of the composition also defines the alkaline characteristics of the compositions and amounts to an equivalent of about 2.79 percent of sodium oxide based on the total weight of the composition, although this value can vary anywhere from about 2.0 to about 10.0 percent, and especially from about 2.25 to about 8.5 percent.

Lastly, the cleaning composition may also contain additional components such as perfumes, dyes, pigments and thickeners.

The following examples illustrate the invention.

EXAMPLE 1

Table 1 lists compositions of the invention prepared for testing and test results:

TABLE 1

Non-Phosphate Heavy Duty Degreaser Formulation Matrix 102-41
Drive-Through Cleaning Test (On Motor Oil)/Formula Comparison vs. Phosphate

| | Ingredients | Comparative Example (Phosphate) | 41-1 | 41-2 | 41-3 | 41-4 | 41-5 | 41-6 | 41-7 | 41-8 |
|---|---|---|---|---|---|---|---|---|---|---|
| Builder | EDTA-$Na_4$ (30%) | 13.65 | 27.0 | 27.0 | — | — | — | — | — | 20.0 |
| | $HP_3PO_4$ (75%) | 4.52 | — | — | — | — | — | — | — | — |
| | Sodium Citrate | — | — | 8.0 | 8.0 | 6.0 | 5.0 | 5.0 | 5.0 | — |
| | Polyacrylate, Acusol 505N (35%) | — | — | — | — | — | — | 5.0 | 5.0 | — |
| Surfactant | Surfonic L12-6 | 2.03 | — | — | — | — | — | — | — | — |
| | Neodol 91-2.5 | 2.03 | — | — | — | — | — | — | — | — |
| | Neodol 1-5 | — | 4.0 | 4.0 | 4.0 | 4.0 | 4.0 | 4.0 | 4.0 | 4.0 |
| | Poly Tergent Ultra A (85%) | — | 1.0 | — | 1.0 | — | 1.0 | 1.0 | — | — |
| Hydrotrope | Sodium Xylene Sulfonate (40%) | 15.10 | 15.0 | 15.0 | 15.0 | 15.0 | 8.0 | 10.0 | 10.0 | 10.0 |

TABLE 1-continued

Non-Phosphate Heavy Duty Degreaser Formulation Matrix 102-41
Drive-Through Cleaning Test (On Motor Oil)/Formula Comparison vs. Phosphate

| | Ingredients | Comparative Example (Phosphate) | 41-1 | 41-2 | 41-3 | 41-4 | 41-5 | 41-6 | 41-7 | 41-8 |
|---|---|---|---|---|---|---|---|---|---|---|
| Alkalinity | Potassium Hydroxide (45%) | 13.39 | 1.0 | 1.0 | 1.0 | 1.0 | 1.0 | 1.0 | 1.0 | 1.0 |
| | Potassium Carbonate (47%) | — | 14.0 | 14.0 | 14.0 | 14.0 | 10.0 | 14.0 | 14.0 | 15.0 |
| | Sodium Meta Silicate.$5H_2O$ | 0.42 | — | — | — | — | — | — | — | |
| Perfume/Dye | | 0.15/0.0034 | — | — | — | — | — | — | — | — |
| Solvent | Water | 48.71 | 38.0 | 39.0 | 39.0 | 58.0 | 70.0 | 60.0 | 61.0 | 50.0 |
| | | 100.00 | 100.00 | 100.00 | 100.00 | 100.00 | 100.00 | 100.00 | 100.00 | 100.00 |
| | pH (neat) | 13.20 | 13.64 | 13.54 | 13.02 | 13.08 | 12.98 | 12.88 | 13.34 | 13.54 |
| | Drive-Through Cleaning Test* Usage Concentration 0.5% | 2.48 | 2.33 | 3.00 | 2.33 | 3.67 | 4.00 | 2.67 | 3.50 | 1.33 |

*Numerical ranking was based on average of 3 different tests; lowest number represents the best cleaning of spent motor oil that had accumulated on parking lots.
CONCLUSION:
*Performance Ranking in decreasing order: 41-8 > 41-1 = 41-3 > Comparative example (phosphate) > 41-6 > 41-2 > 41-7 > 41-4 > 41-5
*Prototype 41-8 outperformed Comparative example (phosphate)

The application of Compositions 41-1 to 41-8 shown on Table 1 to concrete, evenly soiled with spent motor oil, when tested against the Comparative (Phosphate) Example 1 gives an indication of their ability to remove spent motor oil from concrete surfaces. The test areas for application of the composition comprised 0.25 square feet at a concentration of 0.50 percent aqueous solution. The compositions remained in the test area for 3 hours. After rinsing the test area thoroughly with water, an evaluation of each composition relative to the others showed the differences between them in Table 1.

The concrete cleaning comprised setting out a concrete area (free of traffic) about 5 square feet. The evaluation only used concrete evenly soiled with used motor oil. After applying the compositions of Table 1 to the test area by means of a paint roller tray and paint roller brush and allowing the solutions to remain for a period of three hours, the surface was thoroughly rinsed with fresh water and allowed to dry for evaluation. A preference of the concrete cleaners was then determined by comparing the amount of soil removed by the various solutions from the test site. The degree of cleaning, i.e., removal of oil was given a numerical score on a scale of 1 to 5, 1 being the best or completely clean, and an average of several data points was taken.

A unique combination of EDTA-$Na_4$ and potassium carbonate builders in the heavy duty degreaser formulation (10241-8) gave an unexpected superior performance in drive-through motor oil cleaning at the lowest formulation cost compared to other nonphosphate or phosphate compositions. EDTA-$Na_4$ and potassium carbonate builders are both weak builders, and provided the best, yet unexpected performance compared to a comparative phosphated product and other nonphosphated products formulated, and tested.

Initially, formulation emphasis and optimization concentrated on the removal of spent motor oil from concrete parking lot and drive-through concrete paths in fast-food restaurant areas. The test evaluated a series of nonionic surfactants (Neodols, Surfonic, Poly Tergent) and nonionic-anionic surfactants as a blend (Poly Tergent, Ultra), either alone or in combination in a non-phosphate base formulation. Neodol 1-5 nonionic surfactant solely delivered the best oil removal performance and separation stability of all the surfactants tested. Neodol 1-5 has a 11-carbon chain hydrophobe with 5 moles of EO and an HLB of 11.2. Formulation emphasis centered on non-phosphate builder optimization, after taking into account the composition of motor oil, which contains surfactants and additives added as Ca and Mg salts. EDTA-$Na_4$ and $K_2CO_3$ provided an excellent synergistic effect and delivered the best performance in drive-through cleaning as compared to a conventional phosphate cleaner. EDTA-$Na_4$ shows better cleaning ability as a builder than sodium citrate alone or sodium citrate in combination with low molecular weight sodium polyacrylates. Poly Tergent Ultra A, a blend of surfactants (Dowfax with amine functionality, alkoxy ether and ethoxy carboxylate), when used with Neodol 1-5 shows some additional performance benefit, especially in citrate-built formulations employed in drive-through motor oil cleaning.

Table 1 shows a matrix of formula compositions varying in builders and surfactants along with performance data obtained from concrete drive-through cleaning of motor oil. Formulation 10241-8 which has a raw material cost exactly the same as the comparative example phosphated cleaner performed better in drive-through cleaning than the comparative example phosphated composition or any of the other prototypes in Table 1.

EXAMPLE 2

A test of Composition 10241-8 against the Comparative Example given in Table 1 provides an evaluation of the compositions' ability to remove grease from deep-fat-fryer equipment. The test employed a 50-weight percent aqueous solution of Composition 10241-8 at the same concentration of the Comparative Example solution. Applying each one to stainless steel deep-fat-fryer equipment soiled with completely and partially carbonized or polymerized oil or shortening residues from the preparation of french fried potatoes, tested the cleaning power of each composition.

Formula 102 41-8 performed well in a fryer boil out cleaning evaluation and did better than the control which was the same Comparative example (phosphate) shown in Table 1.

The compositions listed in Table 1 were employed to boil out a commercial fryer used for a period of time to the point where carbonized and/or polymerized shortening or cooking oil built up on the inside walls of the fryer. The various compositions of Table 1, when placed into each fryer containing the carbonized and/or polymerized shortening or cooking oil removed the buildups when brought to the boiling point. Formulation 102-41-8 showed greater removal of these buildups than the other compositions listed in Table 1 where all were employed in the boil out test of deep fat fryers having approximately the same amount of carbon and/or polymerized shortening or cooking oil with all compositions at the same concentration.

The foregoing clearly demonstrates the advantages of the present heavy duty degreaser cleaning compositions which do not contain phosphates as a builder.

The various numerical ranges describing the invention as set forth, throughout the specification also include any combination of the lower ends of the ranges with the higher ends of the ranges set forth herein including, inter alia, ranges of concentrations of compounds, ratios of these compounds to one another, molecular weights, pH, ratios of polymer units or polymer blocks to one another, average number of polymer blocks in the polymer compounds of the invention, and the like, as well as all whole number and/or fractional number values and ranges encompassed within these ranges.

It will be apparent that the skilled artisan can make various modifications and variations of the cleaning compositions and methods disclosed above without departing from the spirit of the invention. Therefore, the applicant intends that the present written description covers the modifications and variations of this invention provided that they come within the scope and the spirit of the appended claims and their equivalents.

I claim:

1. A cleaning composition, consisting essentially of:

(a) about 5 to about 35 percent by weight of tetrasodiumethylenediaminetetraacetate;

(b) about 2 to about 35 percent by weight of potassium carbonate;

(c) about 0.5 to about 15 percent by weight of a linear primary alcohol ethoxylate;

(d) about 0.5 to about 15 percent by weight of sodium xylene sulfonate;

(e) about 0.25 to about 10 percent by weight of an alkali metal hydroxide; and (f) balance water.

2. A heavy duty degreaser cleaning composition made by combining compounds consisting essentially of:

(a) about 5 to about 35 percent by weight of tetrasodiumethylenediaminetetraacetate;

(b) about 2 to about 35 percent by weight of potassium carbonate;

(c) about 0.5 to about 15 percent by weight of a linear primary alcohol ethoxylate;

(d) about 0.5 to about 15 percent by weight of sodium xylene sulfonate;

(e) about 0.25 to about 10 percent by weight of an alkali metal hydroxide; and (f) balance water.

* * * * *